US006923479B2

(12) United States Patent
Aiyama et al.

(10) Patent No.: US 6,923,479 B2
(45) Date of Patent: Aug. 2, 2005

(54) DOOR OPENING/CLOSING CONTROL APPARATUS FOR A VEHICLE

(75) Inventors: Takaya Aiyama, Toyota (JP); Norikazu Kobayashi, Chita (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 177 days.

(21) Appl. No.: 10/318,008

(22) Filed: Dec. 13, 2002

(65) Prior Publication Data

US 2003/0122426 A1 Jul. 3, 2003

(30) Foreign Application Priority Data

Dec. 14, 2001 (JP) ..... 2001-382063

(51) Int. Cl.[7] ..... E05C 3/06
(52) U.S. Cl. ..... 292/201; 70/256; 70/262
(58) Field of Search ..... 292/DIG. 22, DIG. 26, 292/DIG. 41, DIG. 65; 70/254–257, 262–269

(56) References Cited

U.S. PATENT DOCUMENTS 4,717,290 A * 1/1988 Reynolds et al. ..... 407/34
4,762,348 A * 8/1988 Matsumoto ..... 292/201
4,778,206 A * 10/1988 Matsumoto et al. ..... 292/201
4,835,533 A * 5/1989 Akutsu ..... 340/5.3
5,713,613 A 2/1998 Honma et al.
5,901,991 A * 5/1999 Hugel et al. ..... 292/201
6,102,453 A * 8/2000 Cetnar ..... 292/201

FOREIGN PATENT DOCUMENTS

| | | |
|---|---|---|
| EP | 0 959 205 A1 | 11/1999 |
| EP | 1 288 403 A2 | 3/2003 |
| FR | 2 783 547 A1 | 3/2000 |
| JP | 3-139450 | 6/1991 |
| JP | 2000-314258 | 11/2000 |
| WO | WO 00/39422 A1 | 7/2000 |

* cited by examiner

*Primary Examiner*—John B. Walsh
(74) *Attorney, Agent, or Firm*—Burns, Doane, Swecker & Mathis, LLP

(57) ABSTRACT

A vehicle door opening/closing control apparatus includes a first operating member assembled to an inner side of a vehicle door for operating an actuator capable of opening/closing the vehicle door by manual operation, a controlling means for controlling the actuator to be in an operable or non-operable condition in response to the manual operation of the first operating member, a second operating member assembled to the inner side of the vehicle door for switching the condition of the actuator to be the operable or non-operable condition by manual operation of the second operating member, and an indicating means for indicating the controlled condition of the actuator.

16 Claims, 15 Drawing Sheets

DOOR OPENING/CLOSING CONTROL APPARATUS FOR A VEHICLE

CROSS REFERENCE TO RELATED APPLICATIONS

This application is based on and claims priority under 35 U.S.C. §119 with respect to a Japanese Patent Application 2001-382063, filed on Dec. 14, 2001, the entire content of which is incorporated herein by reference.

FIELD OF THE INVENTION

This invention generally relates to a vehicle door opening/closing control apparatus. More particularly, this invention pertains to a vehicle door opening/closing control apparatus provided with a controller for controlling an actuator to operate a latch mechanism capable of opening/closing the vehicle door and for switching a controlled condition of the actuator.

BACKGROUND OF THE INVENTION

A Japanese Patent publication No. 2000-314258 discloses a door lock control device as a vehicle door opening/closing control apparatus. The door lock control device is provided with a latch mechanism capable of switching an opened/closed condition of a vehicle door relative to a vehicle body, an actuator capable of operating the latch mechanism, a controller capable of switching a controlled condition of the actuator between an operable condition and a non-operable condition and, a locking/unlocking switch disposed at an inner side of the vehicle door for operating the controller.

However, there is no description about an indicating unit for indicating the controlled condition of the actuator. According to another conventional door opening/closing control apparatus provided with a mechanical door lock mechanism, a member of the door lock mechanism is utilized as the indicating unit for indicating whether the door has been under a door locked condition or under a door unlocked condition. For example, a door lock knob is utilized for switching the door to be either the door locked condition or the door unlocked condition. Therefore, the door locked/unlocked condition is represented by an operated condition of the door lock knob. An indicate of the door locked/unlocked condition is effective for an occupant to confirm the door to be under the locked or unlocked condition not only when the occupant is opening the vehicle door but also while the vehicle has been driving.

Therefore, according to the aforementioned door lock control device not having the indicating unit for indicating the controlled condition of the actuator, the occupant can not confirm whether or not the actuator has been under the operable condition or under the non-operable condition, i.e. whether or not the door opening/closing control apparatus has been under a locked condition or under an unlocked condition.

Accordingly, the present invention therefore seeks to provide an improved door opening/closing control apparatus provided with an electric door lock device capable of allowing the occupant to confirm whether the controlled condition of the actuator is under the locked condition or under the unlocked condition.

SUMMARY OF THE INVENTION

According to an aspect of the present invention, a vehicle door opening/closing control apparatus includes an actuator for switching a vehicle door relative to a vehicle body from a closed condition to an open condition by operating a holding means for holding the vehicle door at the closed condition relative to the vehicle body, a first operating member assembled to an inner side of the vehicle door for operating the actuator by manual operation, a controlling means for controlling the actuator to be in an operable or non-operable condition in response to the manual operation of the first operating member, a second operating member assembled to the inner side of the vehicle door for switching the condition of the actuator to be either the operable or non-operable condition by manual operation of the second operating member, and an indicating means for indicating the controlled condition of the actuator. Therefore, the vehicle door opening/closing control apparatus provided with the indicating means is effective for an occupant to confirm whether the controlled condition of the actuator is either the operable or non-operable condition.

According to another aspect of the present invention, the controlling means operates the indicating means to indicate the controlled condition of the actuator during the second operating member being under operation, and the controlling means further switches the controlled condition of the actuator to be either the operable or non-operable condition when the operation of the second operating member is completed. Therefore, the number of components requisite for the vehicle door opening/closing control apparatus can be effectively reduced.

According to a further aspect of the present invention, the controlling means operates the indicating means to indicate the controlled condition of the actuator by the manual operation of the first operating member, and the controlling means terminates the indication of the controlled condition of the actuator by the indicating means when a predetermined period of time passes since a termination of the operation of the first operating member. Therefore, compared with another indicating means which is always lighted on, the indicating means of the present invention consumes less electric power and can be applicable for saving electric power to be consumed.

According to a further aspect of the present invention, the controlling means controls the controlled condition of the actuator to be either the operable or non-operable condition with reference to a vehicle moving speed. Therefore, the vehicle door opening/closing operation control apparatus of the present invention is effective to restrain the vehicle door from being unnecessarily opened with reference to the vehicle moving speed.

According to a further aspect of the present invention, the indicating means is an indicator assembled to a portion adjacent to an inner side of the vehicle door, the portion extends approximately orthogonal with a vehicle lateral direction, and an upper portion of the portion is sloping in a vehicle outward direction so that the indicator can be effectively visible from an outside of the vehicle body.

BRIEF DESCRIPTION OF THE DRAWING FIGURES

The foregoing and additional features and characteristics of the present invention will become more apparent from the following detailed description considered with reference to the accompanying drawing figures wherein.

Figure 4:
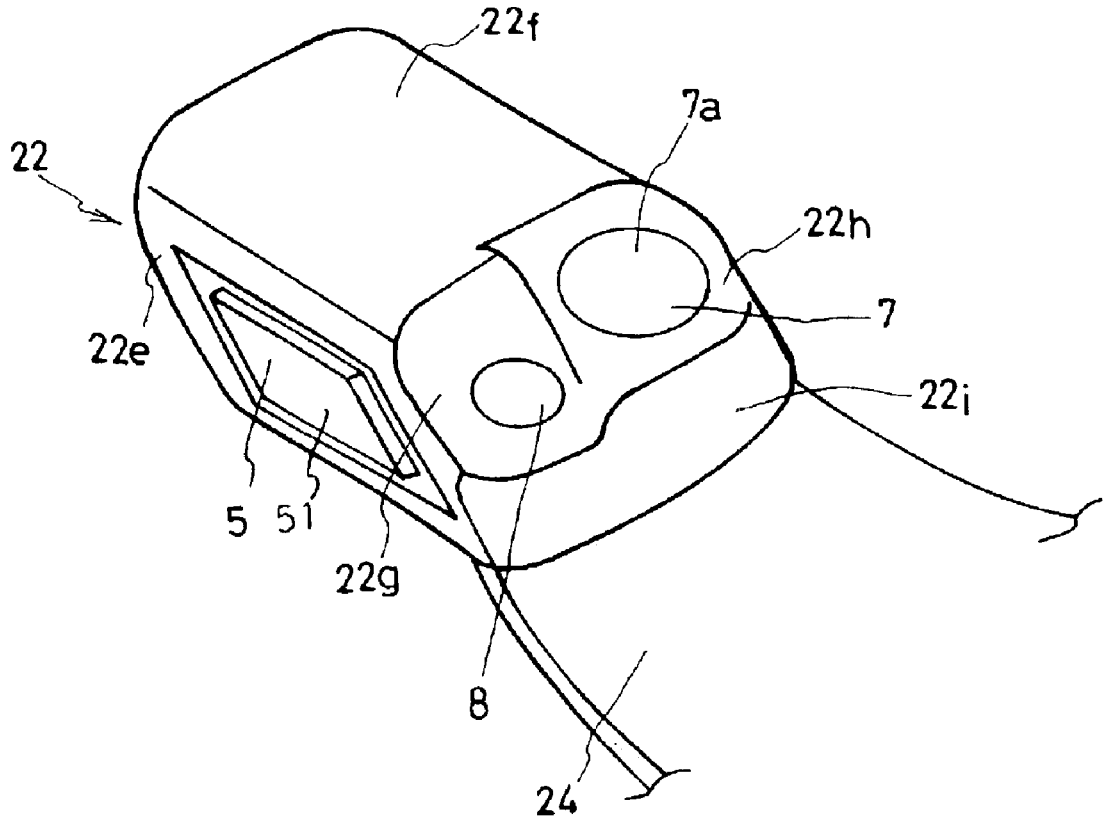
FIG. 4 is an enlarged view illustrating an operating portion of the vehicle door opening/closing control apparatus according to the embodiments of the present invention.
Figure 5:
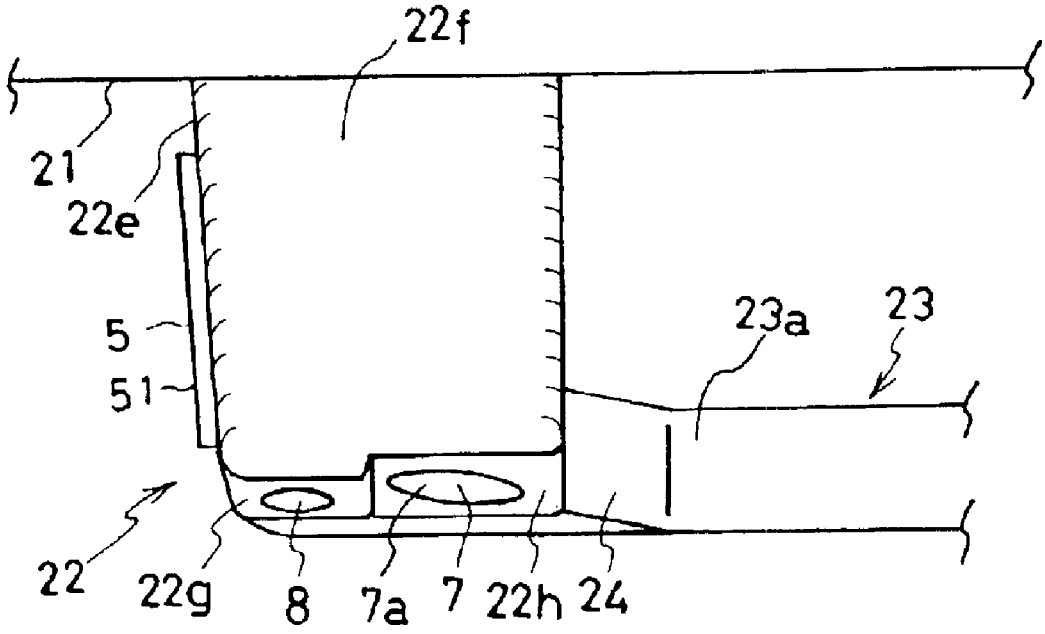
FIG. 5 is another enlarged view illustrating the operating portion in view of a vehicle outward direction from a vehicle inner side.
Figure 6:
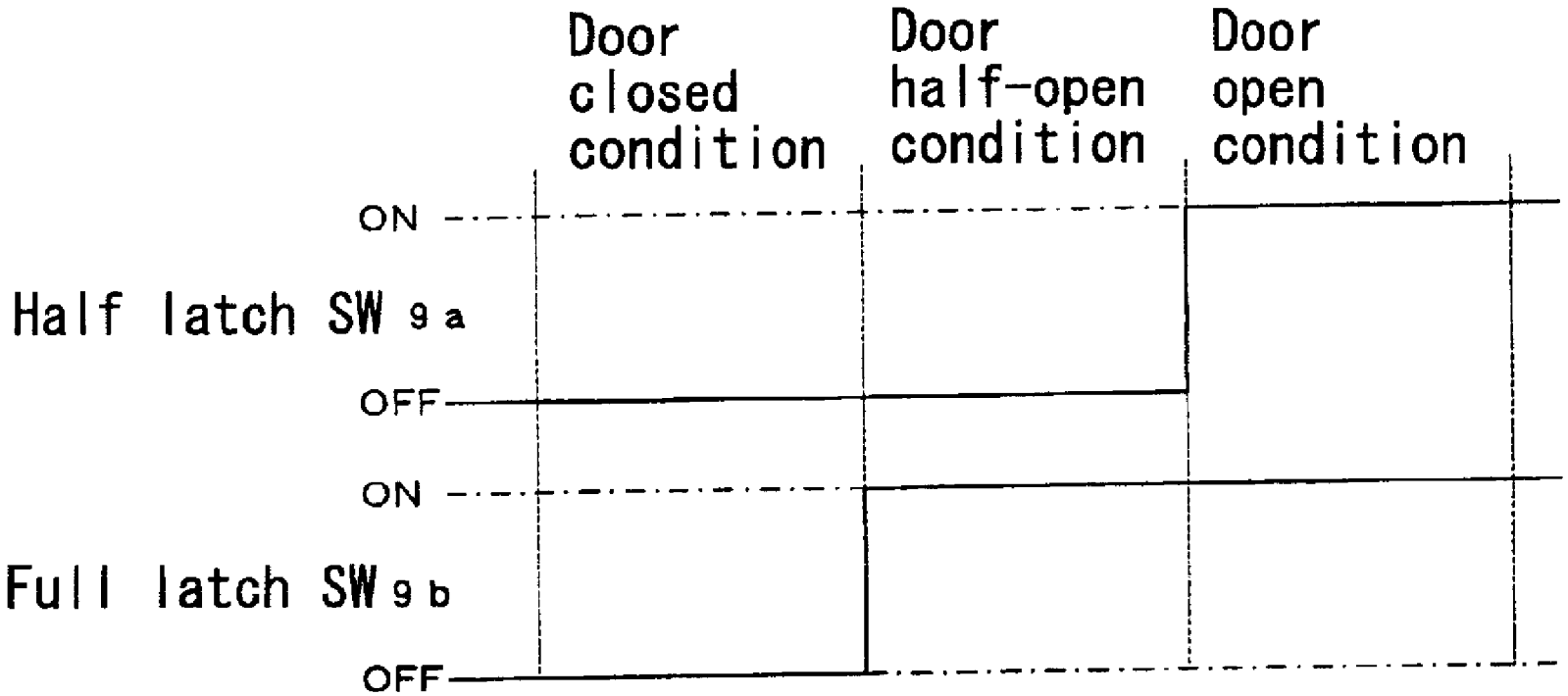
FIG. 6 is an explanatory view for explaining an opened/closed condition of the vehicle door based upon an operated condition of a pole switch of the vehicle door opening/closing control apparatus according to the embodiments of the present invention.
Figure 7:
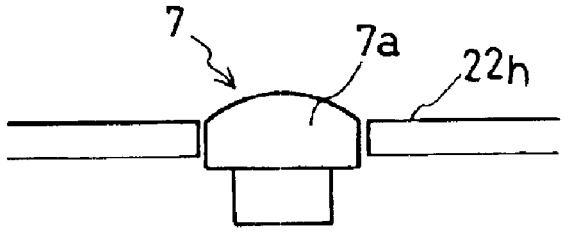
Figure 7:
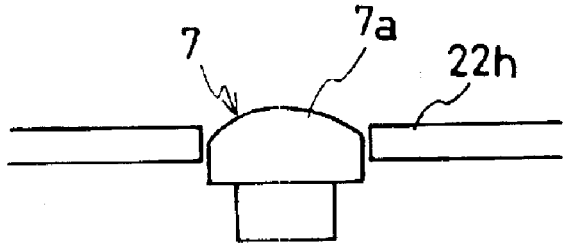
Figure 7:
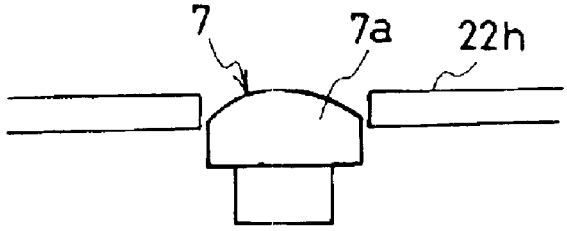
Figure 8:
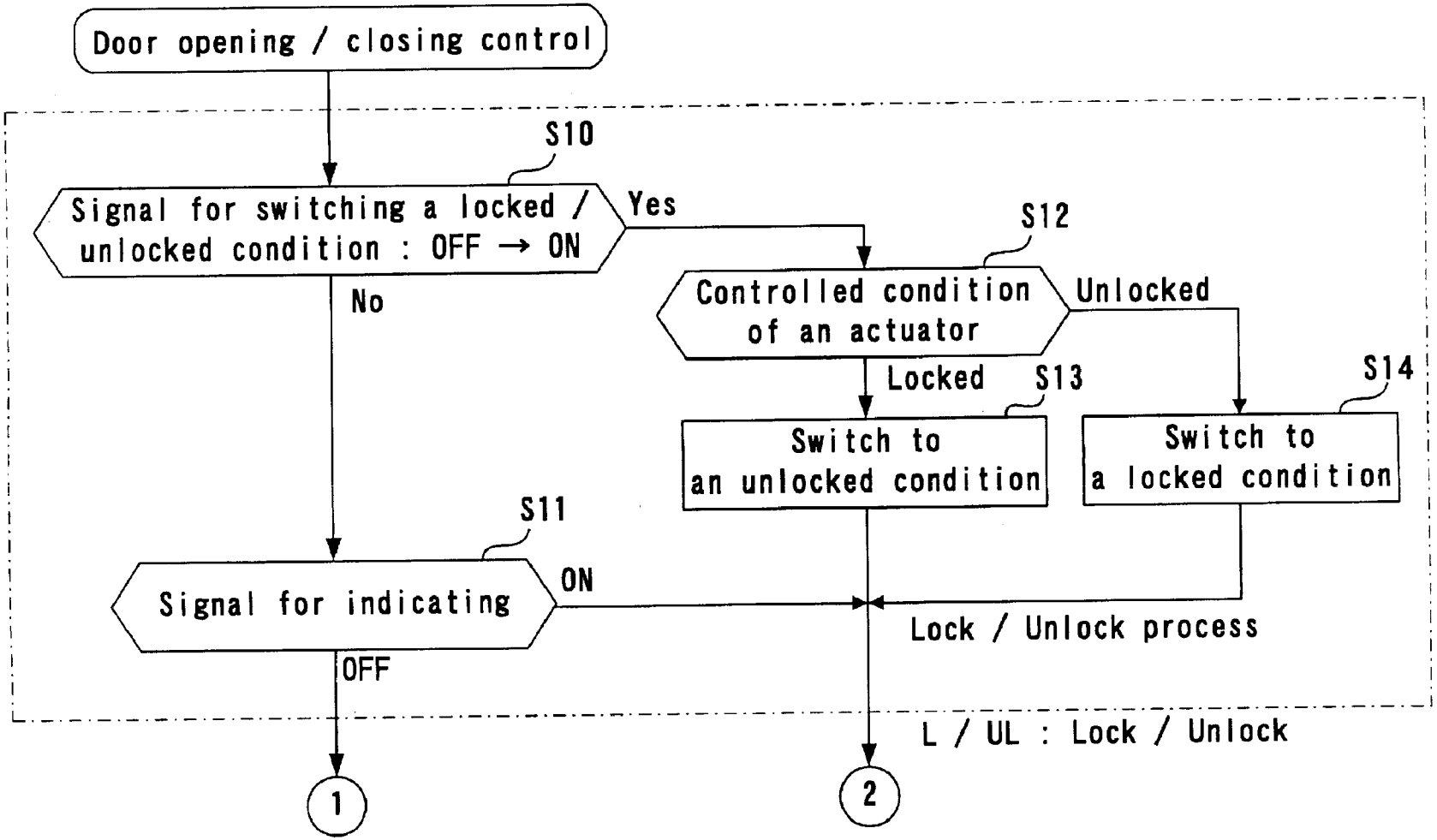
Figure 9:
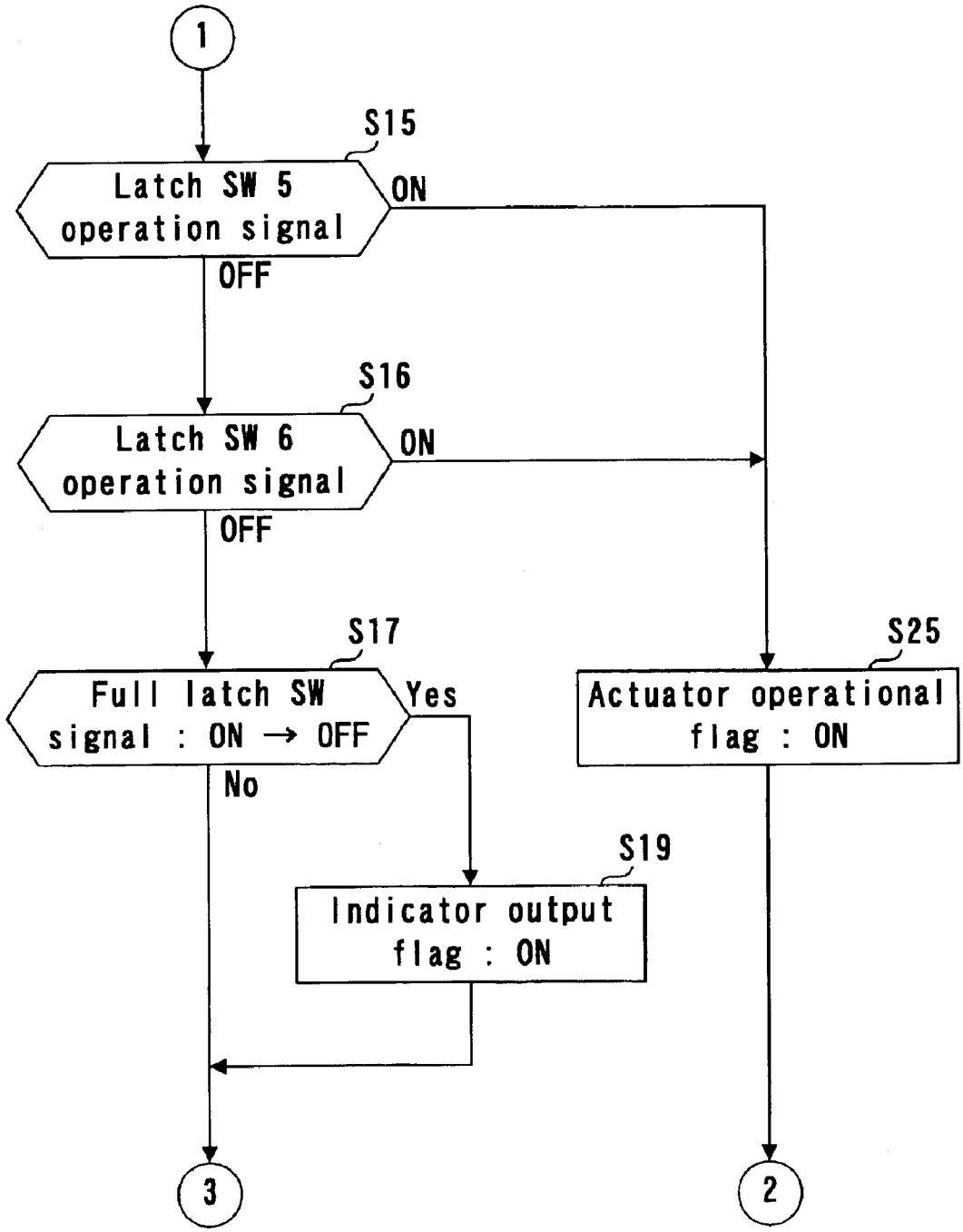
Figure 10:
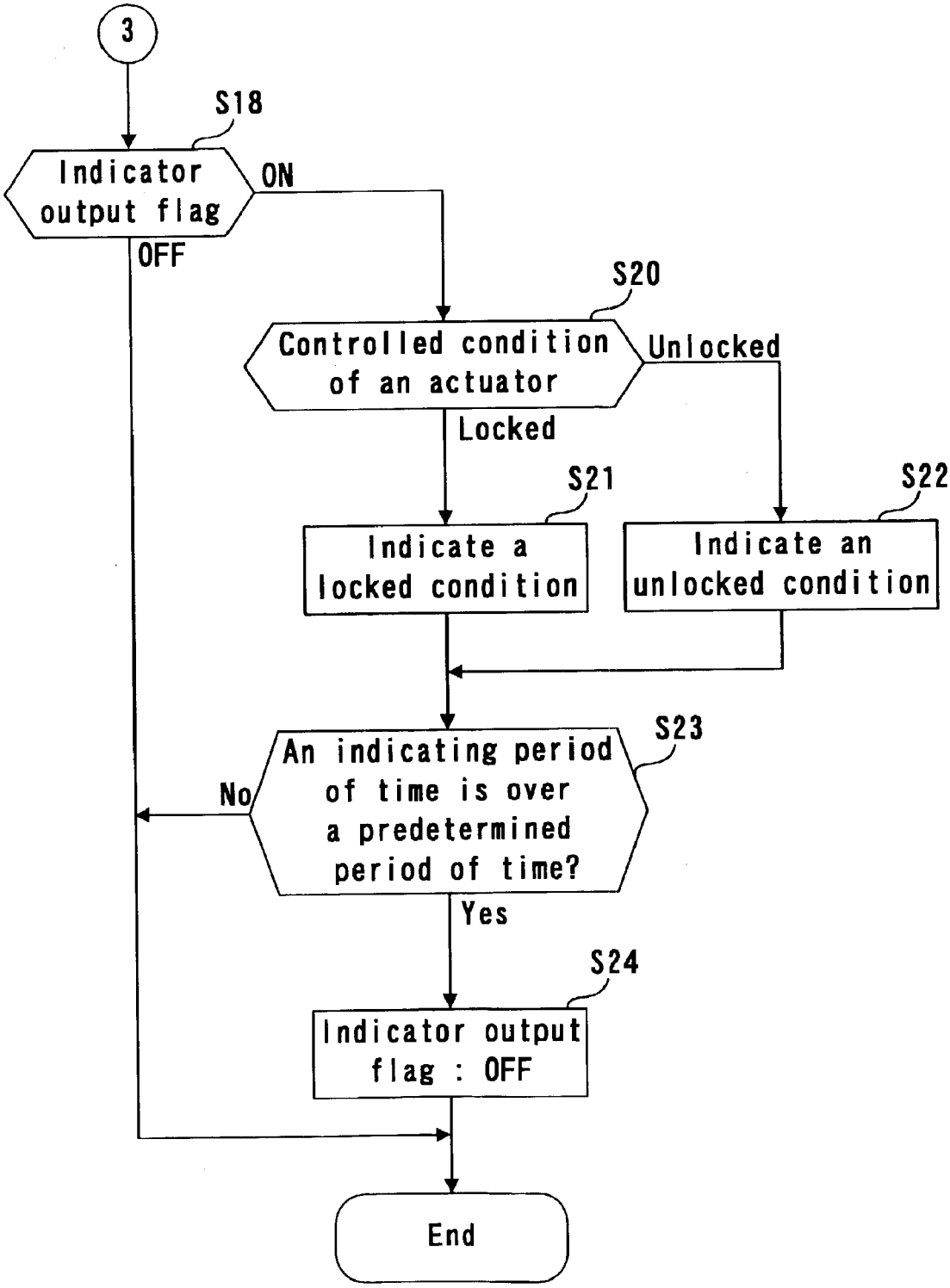
Figure 11:
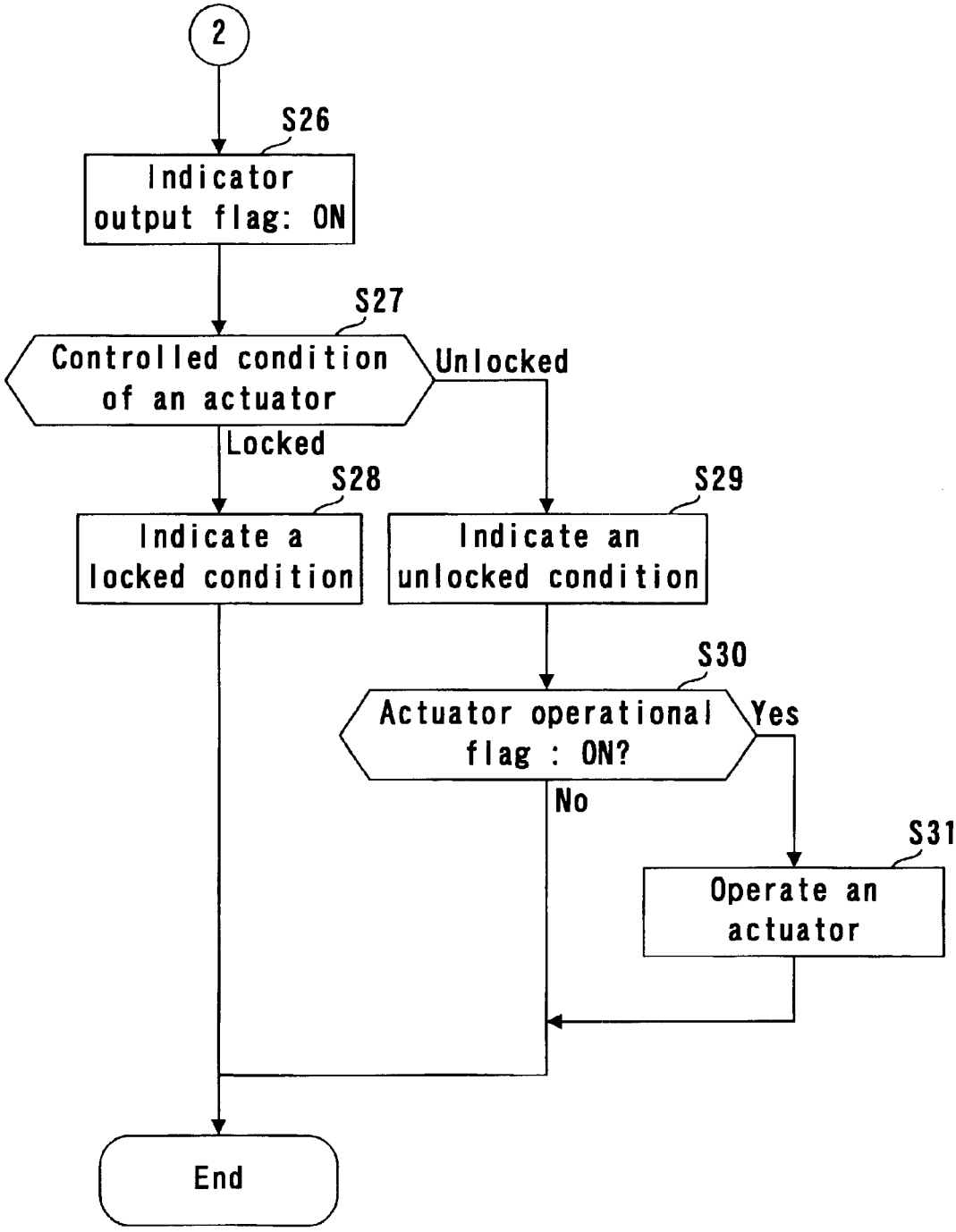
Figure 12:
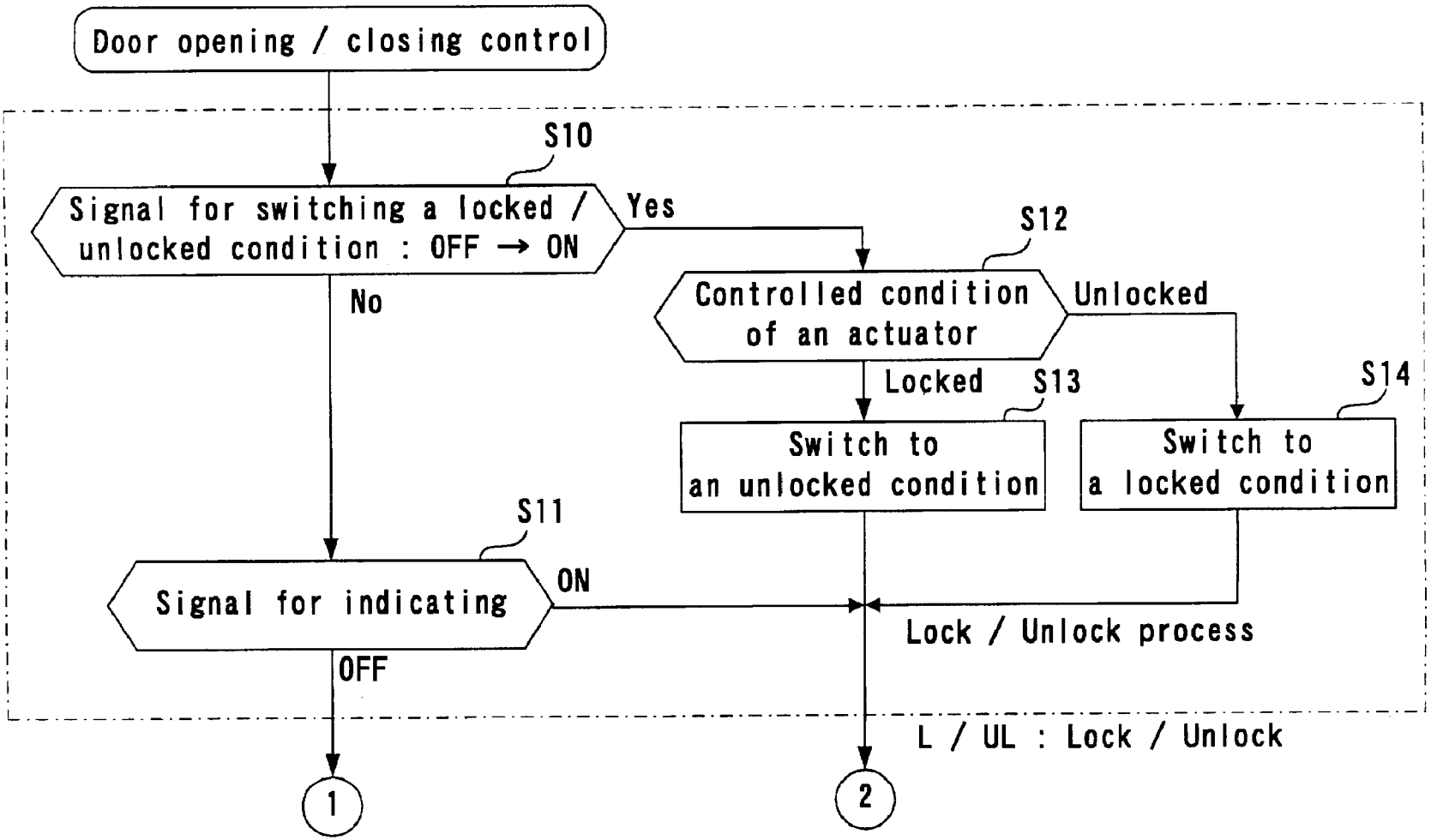
Figure 13:
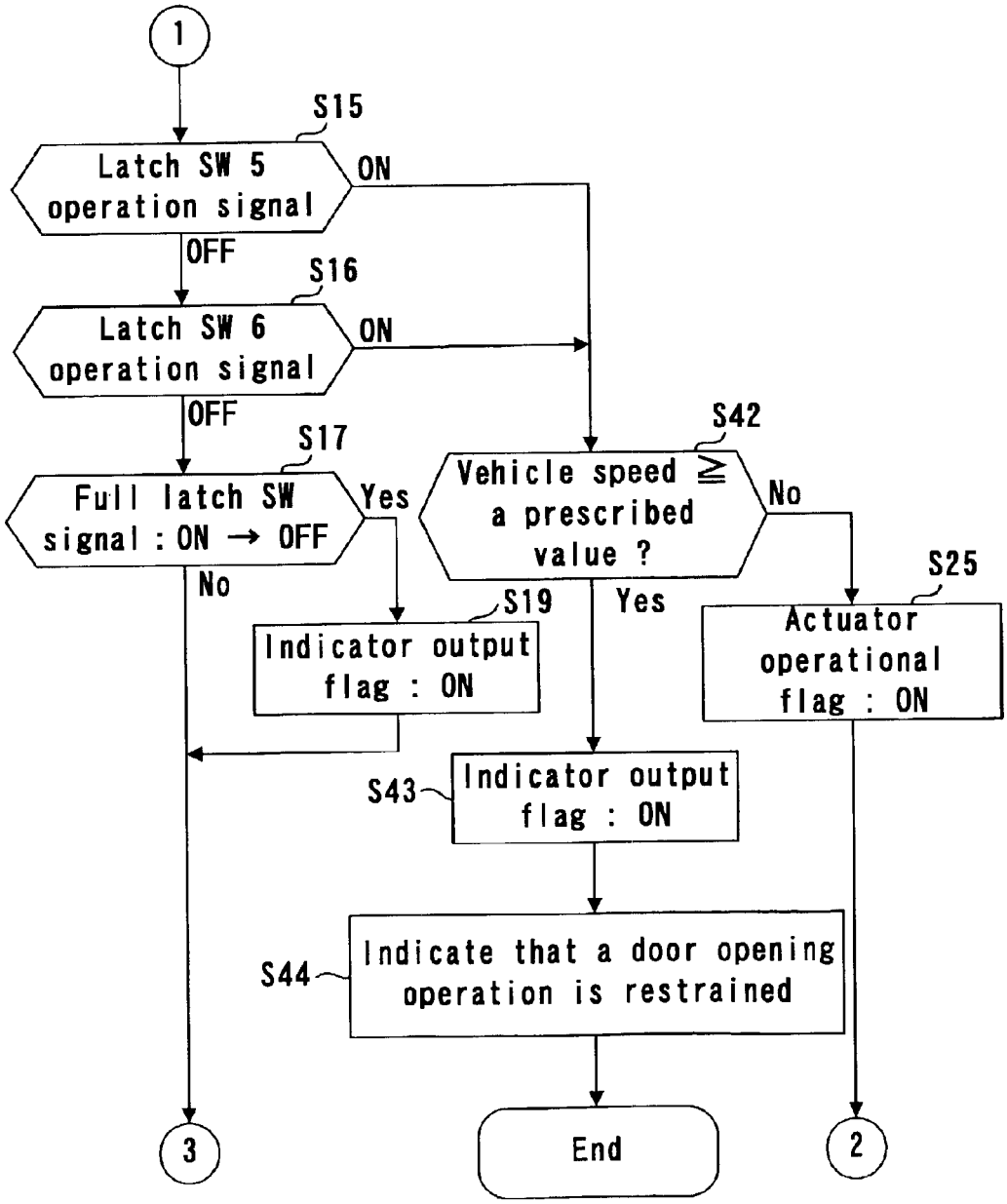
Figure 14:
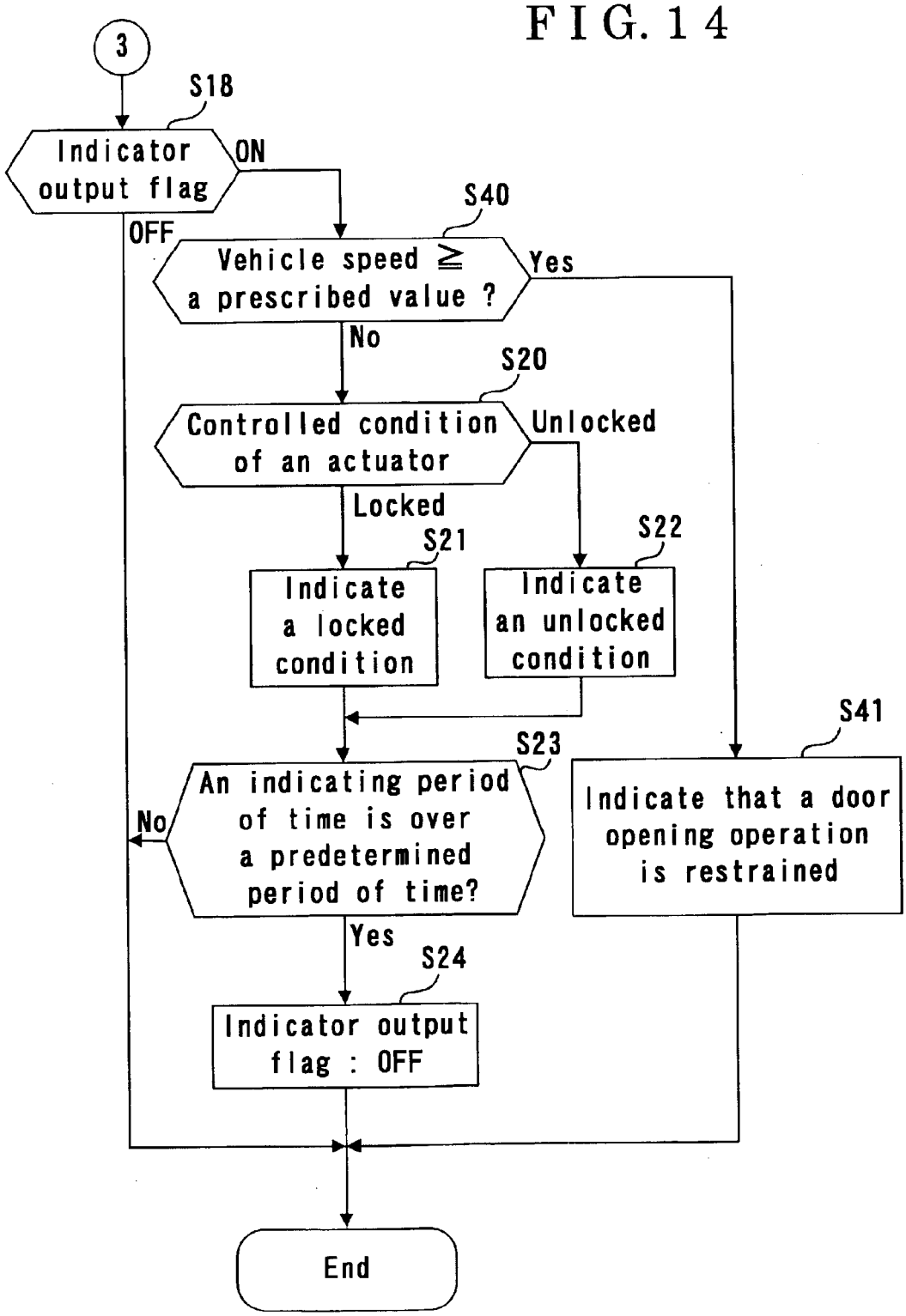
Figure 15:
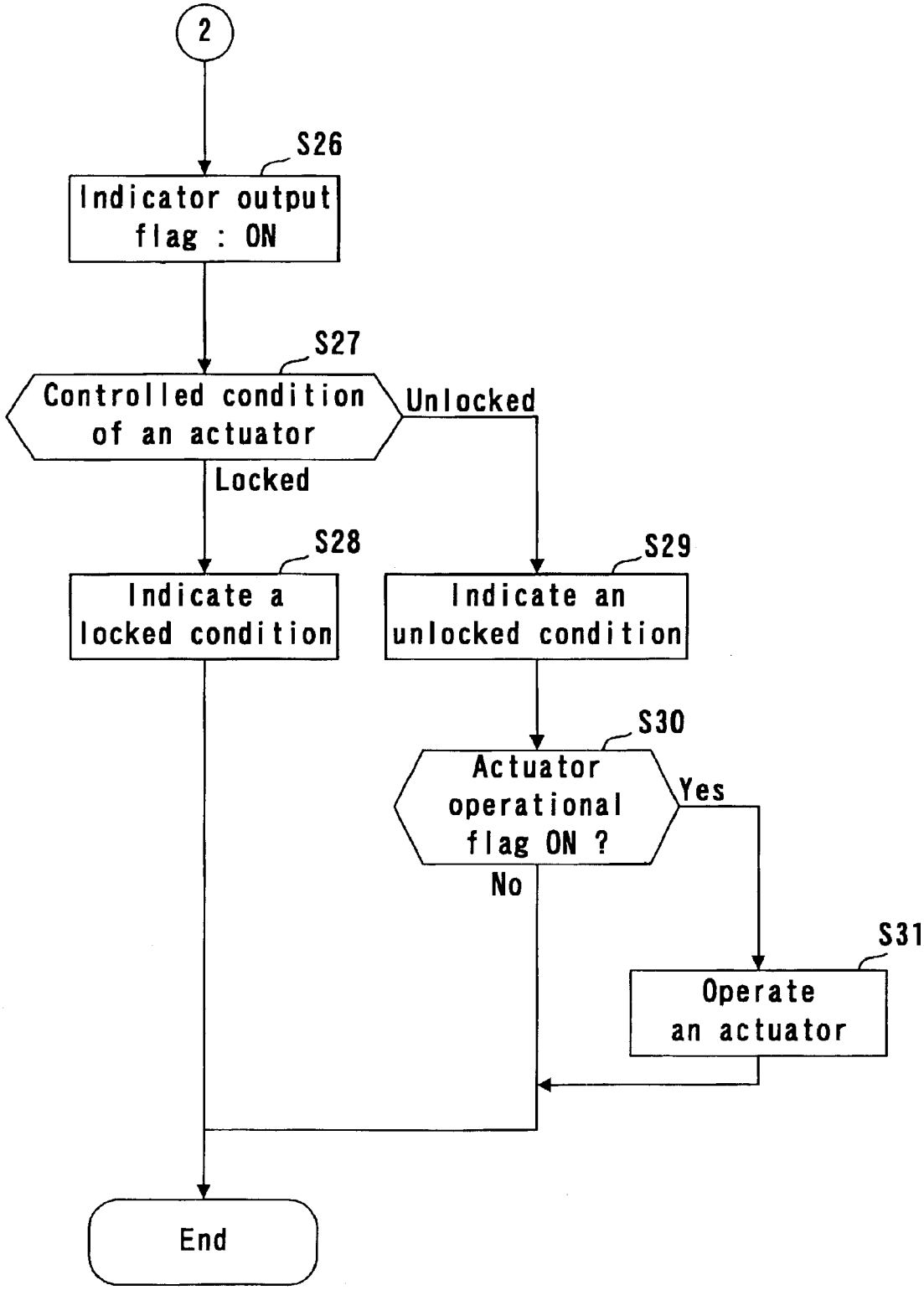

FIGS. 7(*a*), (*b*), and (*c*) illustrate an operated condition of an operating member of the operating portion shown in FIGS. 4 and 5;

FIG. 8 is a part of a flow chart for explaining a process executed by the vehicle door opening/closing control apparatus according to the first embodiment of the present invention;

FIG. 9 is a consecutive part of the flow chart illustrated in FIG. 8 for explaining the process according to the first embodiment of the present invention;

FIG. 10 is a consecutive part of the flow chart illustrated in FIG. 9 for explaining the process according to the first embodiment of the present invention;

FIG. 11 is a consecutive part of the respective flow charts illustrated in FIGS. 8 and 9 for explaining the process according to the first embodiment of the present invention;

FIG. 12 is a part of a flow chart for explaining a process executed by the vehicle door opening/closing control apparatus according to the second embodiment of the present invention;

FIG. 13 is a consecutive part of the flow chart illustrated in FIG. 12 for explaining the process according to the second embodiment of the present invention;

FIG. 14 is a consecutive part of the flow chart illustrated in FIG. 13 for explaining the process according to the second embodiment of the present invention; and FIG. 15 is a consecutive part of the respective flow charts illustrated in FIGS. 12 and 13 for explaining the process according to the second embodiment of the present invention.

DETAILED DESCRIPTION OF THE INVENTION

Figure 1:
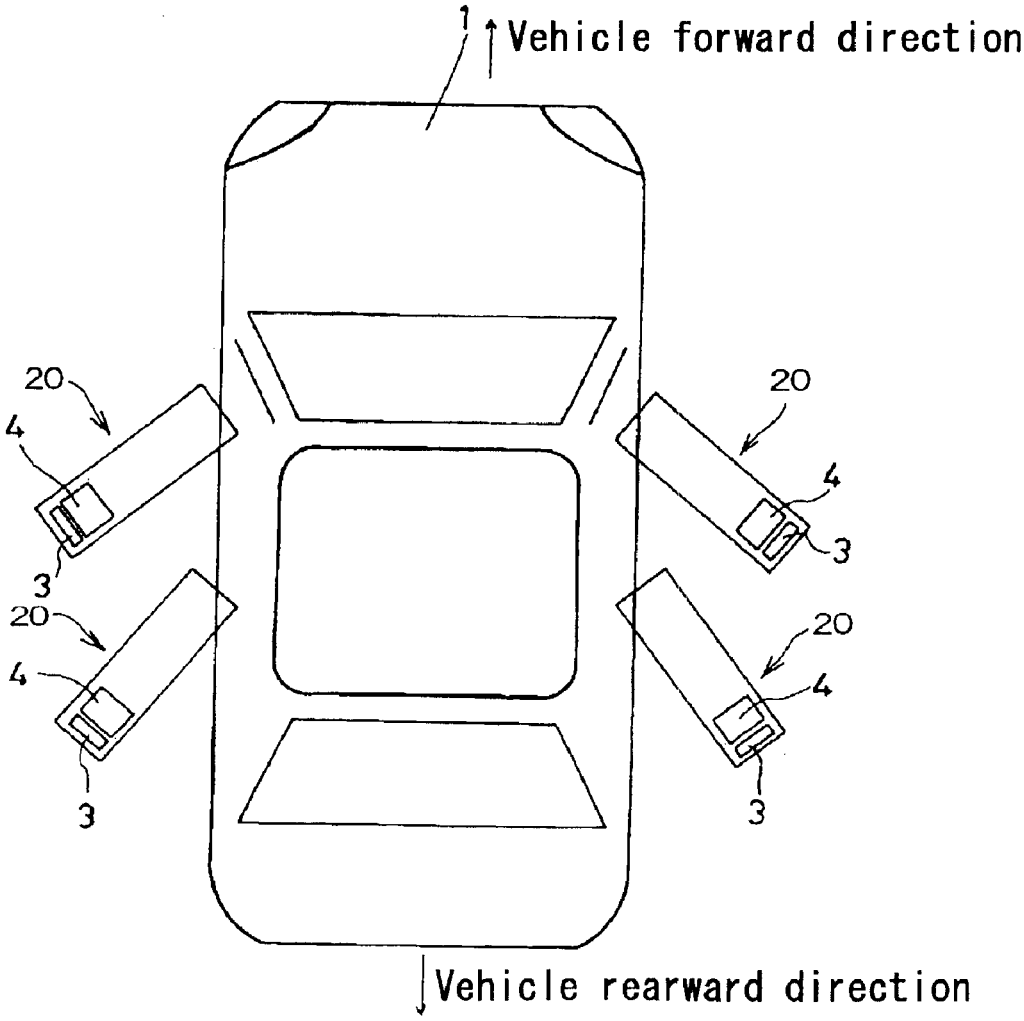
FIG. 1 is a schematic view illustrating a vehicle mounting a vehicle door opening/closing control apparatus therein according to embodiments of the present invention.

As illustrated in FIG. 1, a vehicle is provided with four vehicle doors 20 which are freely opened/closed relative to a vehicle body 1. Each vehicle door 20 houses a latch mechanism (a holding means, not shown) for holding each vehicle door 20 at a door closed condition. More particularly, the latch mechanism holds the vehicle door 20 relative to the vehicle body 1 at the door closed condition by being engaged with a striker (not shown) equipped to the vehicle body 1. Each vehicle door 20 further houses an actuator 3 for operating the latch mechanism and for allowing the vehicle door 20 to be opened. The actuator 3 for each vehicle door 20 is provided with an electric motor M (shown in FIG. 2) as a driving power source and is connected to a controller 4 (a controlling means) mounted in each vehicle door 20.

Each device connected to the controller 4 for each vehicle door 20 according to embodiments of the present invention is described hereinbelow with reference to FIGS. 2 through 6. More details for each device are described later if necessary.

Figure 2:
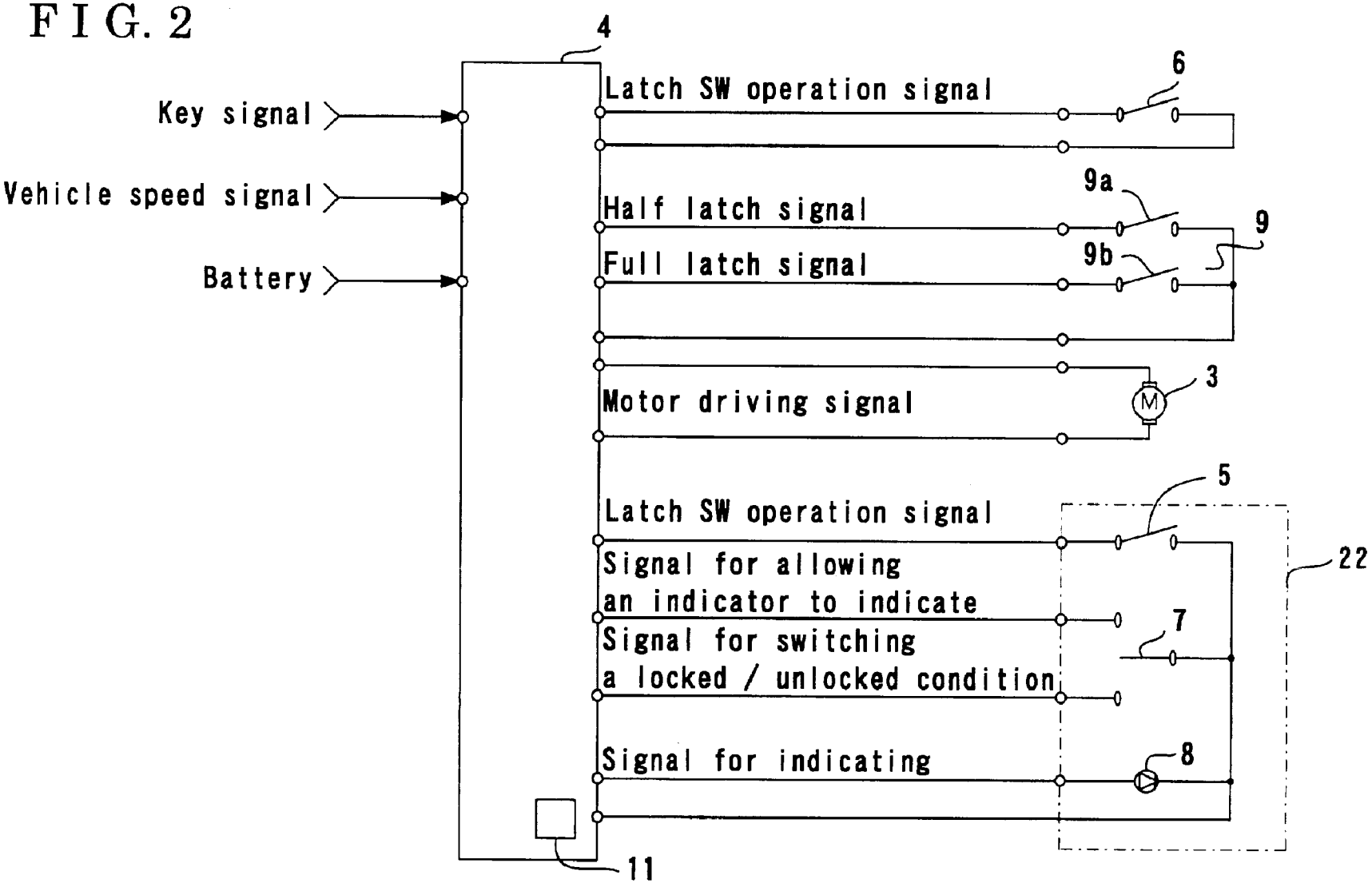
FIG. 2 is a circuit diagram schematically illustrating the vehicle door opening/closing control apparatus according to the embodiments of the present invention.

As seen especially in FIG. 2, the controller 4 for each vehicle door 20 is connected to a latch switch 5 (a first operating member) and a lock switch 7 (a second operating member). The latch switch 5 is assembled to a switch operating portion 22 fixed to a trim 21 (shown in FIG. 3) at an inner side of the vehicle door 20. The latch switch 5 functions for operating the actuator 3 via the controller 4. For example, when the latch switch 5 is operated while the vehicle door 20 has been held relative to the vehicle body 1 at the door closed condition, the actuator 3 is operated so that the latch mechanism is disengaged from the striker. Accordingly, the door 20 is allowed to be opened relative to the vehicle body 1. The controller 4 for each vehicle door 20 is also connected to a latch switch 6 disposed at an outer side of the vehicle door 20. The latch switch 6 functions for activating the actuator 3 in the same manner as the latch switch 5. The lock switch 7 functions for switching a controlled condition of the actuator 3 to be either a non-operable condition (i.e. a locked condition) or an operable condition (an unlocked condition). That is, when the lock switch 7 is operated while the actuator 3 has been at the operable condition, the controller 4 cancels operation signals from the latch switches 5 and 6 even if the latch switches 5 and 6 are operated. Therefore, the actuator 3 is not operated, i.e. is at the locked condition. The lock switch 7 according to the embodiments of the present invention corresponds to a door lock knob at an inner side of a vehicle with a mechanical door lock mechanism.

The controller 4 is further connected to an indicator 8 (an indicating means) disposed on the switch operating portion 22 for each vehicle door 20. The indicator 8 indicates the controlled condition of the actuator 3 being either at the locked condition or at the unlocked condition by lighting on/off a well-known light emitting diode (LED) as a light emitting element. For example, when the actuator 3 has been at the operable condition, the indicator 8 is lighted at red. When the actuator 3 has been at the non-operable condition, the indicator 8 is lighted at green. The light emitting element of the indicator 8 is not limited only to the LED. A method for indicating the controlled condition of the actuator 3 is not limited only to a method in the form of a color as described above and can be applied as an indicating method in the form of a lighting time period or an indicating method in the form of the number of lighting times per unit of time. The indicator 8 is usually lighted off and is lighted on for indicating the condition of the actuator 3 in accordance with any signal which is described later. Therefore, compared with another indicator which is always lighted on, the indicator 8 of the embodiments of the present invention consumes less electric power and can be applicable for saving electric power to be consumed. Further, the indicator 8 according to the embodiments of the present invention indicates the controlled condition of the actuator 3 in the form of the color of the lighted-on LED, i.e. in the form of a light. Alternatively, the indicator 8 can indicate the controlled condition of the actuator 8 in the form of a sound.

The aforementioned lock switch 7 further functions for allowing the indicator 8 to indicate the controlled condition of the actuator 3. That is, the lock switch 7 functions in two ways in accordance with an operated stroke thereof; one is for switching the controlled condition of the actuator 3 to be either the non-operable condition (i.e. the locked condition) or the operable condition (i.e. the unlocked condition), and the other one is for allowing the indicator to indicate the controlled condition of the actuator 3. Details about the lock switch 7 are described later.

The controller 4 is further connected to a pole switch 9 for detecting the operated condition of the latch mechanism, i.e. for detecting whether the vehicle door 20 has been opened or closed. The pole switch 9 includes a half latch switch 9*a* (a half latch SW) and a full latch switch 9*b* (a full latch SW). With reference to a graph illustrated in FIG. 6, both half latch switch 9*a* and full latch switch 9*b* detect the condition of the vehicle door 20 by respectively outputting a binary signal varying between two possible values corresponding to an on/off condition of each switch 9*a* and 9*b*. More specifically, when the half latch SW and the full latch SW are both off, the vehicle door 20 is at the closed condition. When the half latch SW is off and the full latch SW is on, the vehicle door 20 is at a half-open condition. When the half latch SW and the full latch SW are both on, the vehicle door 20 is at an open condition.

The controller 4 is further connected to a vehicle speed sensor (not shown). The vehicle speed sensor is structured as is commonly known and detects a vehicle speed by utilizing a speedometer cable, by utilizing a hall element, by optically detecting a rotational speed of a vehicle wheel, or some other methods. Further, the controller 4 houses a time counter 11 therein.

Figure 3:
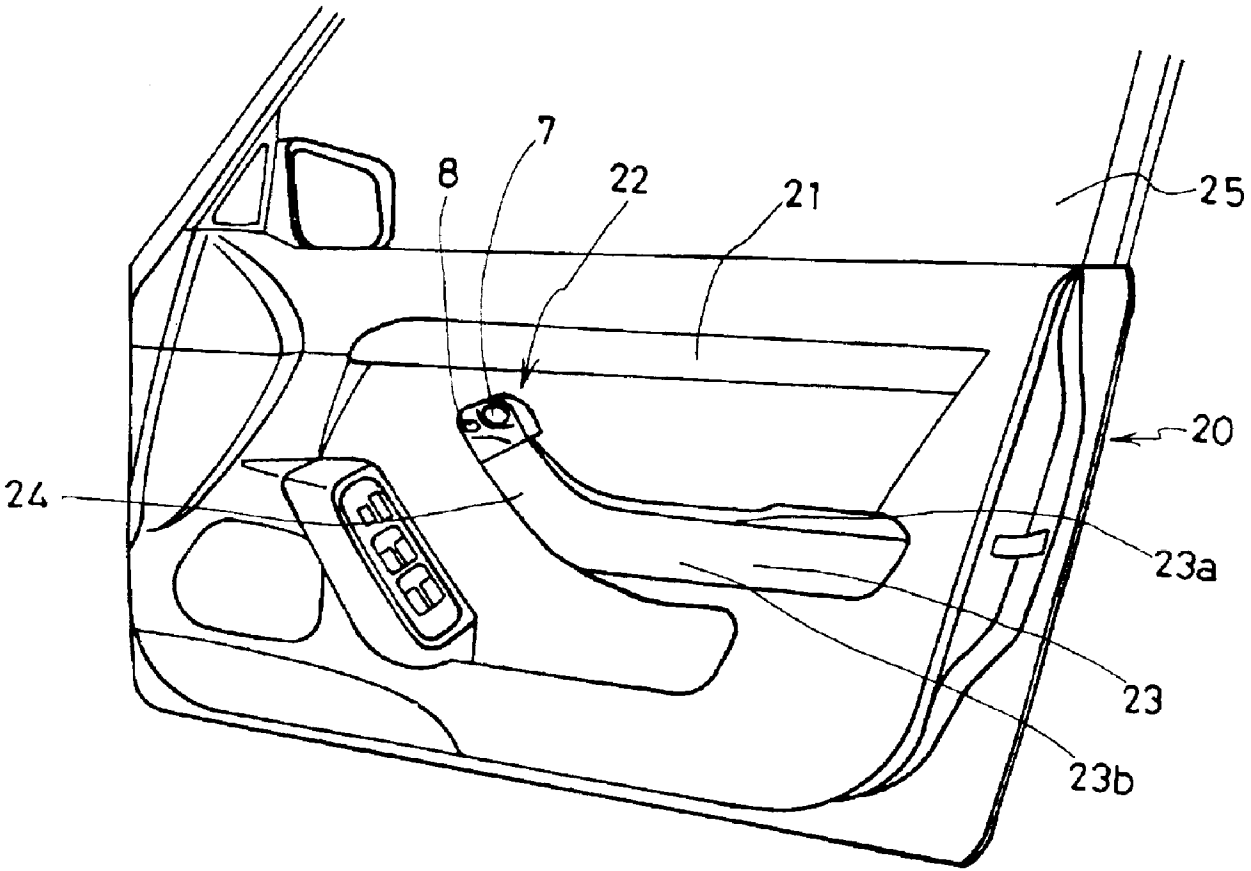
FIG. 3 is a perspective view of a vehicle door mounting the vehicle door opening/closing control apparatus therein according to the embodiments of the present invention.

As seen especially in FIGS. 3, 4, and 5, an arm rest portion 23 is fixed at a central portion in a vehicle vertical direction of the trim 21 of each vehicle door 20 and extends in a vehicle longitudinal direction, i.e. in right and left-hand sides directions in FIG. 3. The arm rest portion 23 includes an arm rest surface 23*a* approximately orthogonal with a surface of the trim 21 and a design surface 23*b* approximately parallel with the trim 21. A grip 24 is disposed at a portion adjacent a front end of the arm rest surface 23*a*. The grip 24 is a bar extending in vehicle forward and upper directions from the front end of the arm rest surface 23*a*. The grip 24 is disposed with a predetermined distance in a vehicle inward direction (i.e. in a lower direction in FIG. 5) from the trim 21. The grip 24 is grasped by an occupant when the occupant is closing the vehicle door 20. The switch operating portion 22 is fixed to an upper portion of the grip 24 via a bracket (not shown) and a screw (not shown). The switch operating portion 22 is further fixed to the trim 21 via a bracket (not shown) and a screw (not shown) in the same manner as aforementioned.

The switch operating portion 22 possesses an approximately rectangular parallelepiped as an outer shape and possesses corner portions being smoothly worked. The switch operating portion 22 is provided with the latch switch 5, the lock switch 7 and the indicator 8. The switch operating portion 22 possesses a front surface portion 22*e* approximately orthogonal with the vehicle longitudinal direction, an upper surface portion 22*f* approximately orthogonal with the vehicle vertical direction, and a side surface portion 22*g* approximately orthogonal with a vehicle lateral direction. The latch switch 5 is assembled to the front surface portion 22*e* and is pushed with a stroke at right angles with the front surface portion 22*e*. An operated surface 51 of the latch switch 5 projects in the vehicle forward direction by the stroke from the front surface portion 22*e*. The stroke is small so that the operated surface 51 is arranged approximately parallel with the front surface portion 22*e* and in the approximately same surface as the front surface portion 22*e*.

The side surface portion 22*g* defines a recessed portion 22*h* at an upper portion of the side surface portion 22*g* and at a vehicle rearward side thereof and another recessed portion 22*i* at a lower portion of the side surface portion 22*g*. The recessed portion 22*h* retracts in a vehicle outward direction. The recessed portion 22*i* retracts in the vehicle outward direction and extends in the vehicle longitudinal direction.

Further, the upper portion of the side surface portion 22*g* (an upper portion in FIG. 4) is slightly sloping in the vehicle outward direction. The lock switch 7 possesses an approximately elliptical shape and is assembled to the recessed portion 22*h*. The lock switch 7 is operated by being pushed with a stroke in the vehicle outward direction which is orthogonal relative to the side surface portion 22*g*. That is, the lock switch 7 is operated in a different direction of the operated direction of the latch switch 5. Therefore, the lock switch 7 and the latch switch 5 can be prevented from being misidentified with each other so that a wrong operation therebetween can be effectively prevented.

Next, a method for operating the lock switch 7 is described with reference to FIG. 7. When a switch portion 7*a* of the lock switch 7 is pushed to a half pushed position (b), the lock switch 7 transmits a signal to the controller 4, which allows the indicator 8 to indicate the controlled condition of the actuator 3. When the switch portion 7*a* is further pushed from the half pushed position (b) to a fully pushed position (c), the lock switch 7 transmits a signal to the controller 4, which switches the controlled condition of the actuator 3 to be either the locked condition or the unlocked condition. Hereinafter, the half pushed position (b) represents a position with an approximately half stroke of a stroke from a non-operated position (a) to the fully pushed position (c). As described above, the lock switch 7 functions in the two ways in accordance with the operated stroke of the switch portion 7*a*, one is for allowing the indicator 8 to indicate the controlled condition of the actuator 3 and the other one is for switching the controlled condition of the actuator 3 to be either the locked condition or the unlocked condition. Therefore, the number of switches can be effectively reduced and an operational performance can be effectively improved.

The indicator 8 is assembled to the side surface portion 22*g* and possesses an approximately elliptical shape. As described above, the upper portion of the side surface portion 22*g* is slightly sloping in the vehicle outward direction. Therefore, the light of the indicator 8 can be visible from the outside of the vehicle via a window 25 (shown in FIG. 3) disposed in the vehicle door 20.

Next, a series of process for controlling opening/closing the vehicle door 20 by the controller 4 according to the first embodiment of the present invention is described with reference to flow charts illustrated in FIGS. 8 through 11. The controller 4 executes the series of process of the flow charts from FIGS. 8 through 11 by a predetermined period of time.

As explained especially by the flow chart illustrated in FIG. 8, the controller 4 judges at step S10 (a second operating member operation judging means) whether or not the signal for switching the controlled condition of the actuator 3 to be either the locked condition or the unlocked condition has been turned on from an off state in response to the operation of the lock switch 7. When a negative judgment (NO) is obtained at step S10, the process proceeds to step S11. When an affirmative judgment (YES) is obtained at step S1, the process proceeds to step S12.

At step S11, the controller 4 judges whether the signal for allowing the indicator 8 to indicate the controlled condition of the actuator 3 in response to the operation of the lock switch 7 is on or off. When the signal is on, the process proceeds to step S26 so that an output flag of the indicator 8 is turned on. On the other hand, when the signal is off, the process proceeds to step S15. Meanwhile, at step S12, the controller 4 judges the controlled condition of the actuator 3. When the actuator 3 is judged to be at the locked condition at step S12, the process proceeds to step S13 so as to switch the condition of the actuator 3 to the unlocked condition. On the other hand, when the actuator 3 is judged to be at the unlocked condition at step S12, the process proceeds to step S14 so as to switch the condition of the actuator 3 to the locked condition. The process then proceeds to step S26 from steps S13 and S14 so that the output flag of the indicator 8 is turned on. Hereinafter, the process from step S10 to step S14 is referred to as a door lock/unlock process.

As explained especially by the flow chart illustrated in FIG. 9, the controller 4 judges at step S15 (a first operating member operation judging means) whether the operation signal from the latch switch 5 is on or off. When the operation signal of the latch switch 5 is on, the process proceeds to step S25 so that an operational flag of the actuator 3 is turned on. The process then proceeds to step S26. On the other hand, when the operation signal of the latch switch 5 is off at step S15, the process proceeds to step S16 so as to judge whether the operation signal of the latch switch 6 is on or off. When the operation signal of the latch switch 6 is on, the process proceeds to step S25 so that the operational flag of the actuator 3 is turned on. The process then proceeds to step S26. On the other hand, when the operation signal of the latch switch 6 is off at step S16, the process proceeds to step S17 so as to judge whether or not a signal from the full latch SW has been switched from on to off. That is, the controller 4 judges at step S17 (a vehicle door condition judging means) whether or not the vehicle door 20 has been switched from the open condition to the closed condition. When the vehicle door 20 is judged at step S17 to have been switched from the open condition to the closed condition, the process proceeds to step S19 so that the output flag of the indicator 8 is turned on. The process then proceeds to step S18 explained by the flow chart illustrated in FIG. 10. On the other hand, when the vehicle door 20 is not judged at step S17 to have been switched from the open condition to the closed condition, the process directly proceeds to step S18.

As described above, it is preferable for the following case that the output flag of the indicator 8 is turned on when the vehicle door 20 has been already switched from the open condition to the closed condition. As described above, the indicator 8 is visible from the outside of the vehicle. Therefore, when a user is closing the vehicle door 20 without using a key while the vehicle door 20 has been at the locked condition, the vehicle door 20 can be confirmed to be at the door locked condition.

As explained especially by the flow chart illustrated in FIG. 10, the controller 4 judges whether the output flag of the indicator 8 is on or off. When the output flag of the indicator 8 is off, the series of process by the flow chart is terminated. On the other hand, when the output flag of the indicator 8 is on at step S18, the process proceeds to step S20 (an actuator controlled condition judging means) so as to judge the controlled condition of the actuator 3. When the actuator 3 is judged at step S20 to be at the locked condition, the process proceeds to step S21 (an actuator controlled condition indicating means) so as to transmit to the indicator 8 the signal for indicating that the actuator 3 is at the locked condition. In this case, the indicator 8 is lighted at a predetermined color, green. On the other hand, when the actuator 3 is judged at step S20 to be at the unlocked condition, the process proceeds to step S22 (the actuator controlled condition indicating means) so as to transmit to the indicator 8 the signal for indicating that the actuator 3 is at the unlocked condition. In this case, the indicator 8 is lighted at another predetermined color, red. The process then proceeds to step S23 from steps S21 and S22.

The controller 4 judges at step S23 (a period of time judging means) whether or not the time counter 11 counts a period of time over a predetermined period of time. Hereinafter, the time counter 11 counts an elapsed time after finishing a pushing operation of the latch switch 5 or the lock switch 7. The counted period of time is incremented by a predetermined period of time of the door opening/closing control. When the counted period of time does not exceed the predetermined period of time at step S23, the series of process is terminated. On the other hand, when the counted period of time exceeds the predetermined period of time at step S23, the process proceeds to step S24 so that the output flag of the indicator 8 is turned off. The series of process is then terminated. As aforementioned, the indicate by the indicator 8 is terminated corresponding to the counted period of time by the time counter 11. Therefore, the indicator 8 according to the first embodiment of the present invention can effectively save electric power to be consumed comparing with another indicator which always keep indicating the condition of the actuator 3.

As explained especially by the flow chart in FIG. 11, when the output flag of the indicator 8 is turned on at step S26, the process proceeds to step S27 (an actuator controlled condition judging means) for so as to judge the condition of the actuator 3. When the actuator 3 is judged at step S27 to be at the locked condition, the process proceeds to step S28 (an actuator controlled condition indicating means) so as to transmit to the indicator 8 the signal for indicating that the actuator 3 is at the locked condition. In this case, the indicator 8 is lighted at green. On the other hand, when the actuator 3 is judged at step S27 to be at the unlocked condition, the process proceeds to step S29 (the actuator controlled condition indicating means) so as to transmit to the indicator 8 the signal for indicating that the actuator 3 is at the unlocked condition. In this case, the indicator 8 is lighted at red. The series of process is then terminated after step S28.

The process from step S29 proceeds to step S30 so as to judge whether the operational flag of the actuator 3 is on or off. When the operational flag of the actuator 3 is judged to be off at step S30, the series of process is terminated. On the other hand, when the operational flag of the actuator 3 is judged to be on at step S30, the process proceeds to step S31 (an actuator operating means) so as to operate the actuator 3. The latch mechanism is hence released from being engaged with the striker and the series of process is terminated.

As described at step S15 and step S25 through step S31, when the latch switch 5 is operated by the occupant while the actuator 3 has been at the locked condition, the occupant can be acknowledged by the indicator 8 being lighted on at green that the latch mechanism can not be operated due to the actuator 3 being at the locked condition. Therefore, the occupant can be acknowledged that the latch mechanism can not operated due to a malfunction thereof.

Next, a series of process for controlling opening/closing the vehicle door 20 by the controller 4 according to the second embodiment of the present invention is described with reference to flow charts illustrated in FIGS. 12 through 15. The controller 4 executes the series of process of the flow charts from FIGS. 12 through 15 by a predetermined period of time. The process according to the second embodiment mostly corresponds to the process according to the first embodiment of the present invention. Therefore, only different points therebetween are described hereinbelow.

As explained especially by the flow chart illustrated in FIG. 14, when the operational flag of the indicator 8 is judged to be on at step S18, the process proceeds to step S40. At step S40 (a vehicle speed judging means), the vehicle speed measured by the vehicle speed sensor is compared with a prescribed value being stored in a memory (not shown) of the controller 4. When the vehicle speed is substantially equal to the prescribed value or greater than that at step S40, the process proceeds to step S41. On the other hand, when the vehicle speed is less than the prescribed value, the process proceeds to step S20. At step S41 (a vehicle door opening operation restraining means), the controller 4 transmits to the indicator 8 a signal for restricting the vehicle door 20 from being opened. The signal for restricting the vehicle door 20 from being opened is blinked at yellow for a predetermined number of times and can be distinguished from other green and red lights.

As explained especially by the flow chart illustrated in FIG. 13, when the operation signal of the latch switch 5 is on at step S15 or when the operation signal of the latch switch 6 is on at step S16, the process proceeds to step S42 (a vehicle speed judging means). At step S42, the vehicle speed measured by the vehicle speed sensor is compared with a prescribed value being stored in the memory of the controller 4. When the vehicle speed is substantially equal to the prescribed value or greater than that, the program proceeds to step S43. On the other hand, when the vehicle speed is less than the prescribed value, the process proceeds to step S25. At step S43, the output flag of the indicator 8 is set on and the process proceeds to step S44 (a vehicle door opening operation restraining means). At step S44, the controller 4 transmits to the indicator 8 the signal for restricting the vehicle door 20 from being opened in the same manner as being described at step S41. The series of process is then terminated.

According to the second embodiment of the present invention, the vehicle door 20 can not be effectively opened when the vehicle speed measured by the vehicle speed sensor is substantially equal to the prescribed value or greater than that even if at least either the latch switch 5 or the latch switch 6 is operated. Therefore, the door opening/closing control apparatus according to the second embodiment of the present invention improves security.

The principles, preferred embodiments and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What we claim is:

1. A vehicle door opening/closing control apparatus, comprising:

an actuator for switching a vehicle door relative to a vehicle body from a closed condition to an open condition by operating a holding means for holding the vehicle door at the closed condition relative to the vehicle body;

a first operating member assembled to an inner side of the vehicle door for operating the actuator by manual operation;

a controlling means for controlling the actuator to be in an operable or non-operable condition in response to the manual operation of the first operating member;

a second operating member assembled to the inner side of the vehicle door for switching the condition of the actuator to be either the operable or non-operable condition by manual operation of the second operating member;

an indicating means for indicating the controlled condition of the actuator and wherein the controlling means controls the controlled condition of the actuator to be either the operable or non-operable condition in response to the manual operation of the first operating member with reference to a vehicle moving speed.

2. A vehicle door opening/closing control apparatus according to claim 1, wherein the controlling means operates the indicating means to indicate the controlled condition of the actuator during the second operating member being under operation, and the controlling means further switches the controlled condition of the actuator to be either the operable or non-operable condition when the operation of the second operating member is completed.

3. A vehicle door opening/closing control apparatus according to claim 2, wherein the controlling means terminates the indication of the controlled condition of the actuator by the indicating means when a predetermined period of time passes since a termination of the operation of the second operating member.

4. A vehicle door opening/closing control apparatus according to claim 1, wherein the controlling means operates the indicating means to indicate the controlled condition of the actuator by the manual operation of the first operating member, and the controlling means terminates the indication of the controlled condition of the actuator by the indicating means when a predetermined period of time passes since a termination of the operation of the first operating member.

5. A vehicle door opening/closing control apparatus according to claim 2, wherein the controlling means operates the indicating means to indicate the controlled condition of the actuator by the manual operation of the first operating member, and the controlling means terminates the indication of the controlled condition of the actuator by the indicating means when a predetermined period of time passes since a termination of the operation of the first operating member.

6. A vehicle door opening/closing control apparatus according to claim 3, wherein the controlling means operates the indicating means to indicate the controlled condition of the actuator by the manual operation of the first operating member, and the controlling means terminates the indication of the controlled condition of the actuator by the indicating means when a predetermined period of time passes since a termination of the operation of the first operating member.

7. A vehicle door opening/closing control apparatus according to claim 1, wherein the holding means is a latch mechanism, the first operating means is a latch switch operated in a vehicle longitudinal direction, and the second operating means is a lock switch operated in a vehicle lateral direction.

8. A vehicle door opening/closing control apparatus according to claim 7, wherein a controller as the controlling means operates the indicating means to indicate the controlled condition of the actuator during the lock switch being under operation, and the controller further switches the controlled condition of the actuator to be either the operable or non-operable condition when the operation of the lock switch is completed.

9. A vehicle door opening/closing control apparatus according to claim 1, wherein the indicating means is an indicator assembled to a portion adjacent to the inner side of the vehicle door, the portion extends approximately orthogonal with a vehicle lateral direction, and an upper portion of the portion is sloping in a vehicle outward direction so that the indicator is visible from an outside of the vehicle body.

10. A vehicle door opening/closing control apparatus according to claim 9, further comprising:

a second operating member operation judging means for judging whether or not the second operating member has been operated for switching the controlled condition of the actuator to be the operable or non-operable condition;

a first operating member operation judging means for judging whether or not the first operating member has been operated when the second operating member operation judging means judges that the second operating member has not been operated;

a vehicle door condition judging means for judging whether or not the vehicle door is at the closed condition when the first operating member operation judging means judges that the first operating member has not been operated;

an actuator controlled condition judging means for judging whether the controlled condition of the actuator is either the operable or non-operable condition when the vehicle door condition judging means judges that the vehicle door is at the closed condition, and an actuator controlled condition indicating means for operating the indicator to indicate that the controlled condition of the actuator is the operable condition when the actuator controlled condition judging means judges that the controlled condition of the actuator is the operable condition and for operating the indicator to indicate that the controlled condition of the actuator is the non-operable condition when the actuator controlled condition judging means judges that the controlled condition of the actuator is the non-operable condition.

11. A vehicle door opening/closing control apparatus according to claim 10, wherein the actuator controlled condition indicating means operates the indicator to be lighted on at a predetermined first color when the controlled condition of the actuator is judged to be the non-operable condition and to be lighted on at another predetermined color being different from the first color when the controlled condition of the actuator is judged to be the operable condition.

12. A vehicle door opening/closing control apparatus according to claim 10, further comprising:

a period of time judging means for judging whether the indicator has indicated the controlled condition of the actuator for a period of time being greater than a predetermined period of time, and the period of time is counted since a termination of the operation of the first operating member or the second operating member while the actuator controlled condition indicating means has operated the indicating means to indicate the controlled condition of the actuator, wherein the actuator controlled condition indicating means terminates the operation of the indicating means to indicate the controlled condition of the actuator when the period of time judging means judges that the indicating means has indicated for the period of time being greater than the predetermined period of time.

13. A vehicle door opening/closing control apparatus according to claim 1, further comprising:

a second operating member operation judging means for judging whether or not the second operating member has been operated for switching the controlled condition of the actuator to be the operable or non-operable condition;

a first operating member operation judging means for judging whether or not the first operating member has been operated when the second operating member judging means judges that the second operating member has not been operated;

an actuator controlled condition judging means for judging whether the controlled condition of the actuator is either the operable or non-operable condition when the first operating member operation judging means judges that the first operating member has been operated;

an actuator controlled condition indicating means for operating the indicating means to indicate that the controlled condition of the actuator is the operable condition when the actuator controlled condition judging means judges that the controlled condition of the actuator is the operable condition and for operating the indicating means to indicate that the controlled condition of the actuator is the non-operable condition when the actuator controlled condition judging means judges that the controlled condition of the actuator is the non-operable condition; and an actuator operating means for operating the actuator when the actuator controlled condition indicating means operates the indicating means to indicate that the controlled condition of the actuator is the operable condition, wherein the actuator is not operated when the actuator controlled condition indicating means operates the indicating means to indicate that the controlled condition of the actuator is the non-operable condition even if the first operating member has been operated.

14. A vehicle door opening/closing control apparatus according to claim 10, further comprising:

a vehicle speed judging means for judging whether or not the vehicle speed is substantially equal to a prescribed value or greater than that when the vehicle condition judging means judges that the vehicle door is at the closed condition;

the actuator controlled condition judging means for judging whether the controlled condition of the actuator is either the operable or non-operable condition when the vehicle speed judging means judges that the vehicle speed is smaller than the prescribed value; and a vehicle door opening operation restraining means for restraining the vehicle door from being opened when the vehicle speed judging means judges that the vehicle speed is substantially equal to the prescribed value or greater than that.

15. A vehicle door opening/closing control apparatus according to claim 13, further comprising:

a vehicle speed judging means for judging whether or not a vehicle speed is substantially equal to a prescribed value or greater than that when the first operating member operation judging means judges that the first operating member has been operated;

the actuator controlled condition judging means for judging whether the controlled condition of the actuator is either the operable or non-operable condition when the vehicle speed judging means judges that the vehicle speed is smaller than the prescribed value; and a vehicle door opening operation restraining means for restraining the vehicle door from being opened when the vehicle speed judging means judges that the vehicle speed is substantially equal to the prescribed value or greater than that.

16. A vehicle door opening/closing control apparatus according to claim 13, wherein the actuator operating means operates the actuator in response to the manual operation of the second operating member while the actuator controlled condition indicating means has operated the indicating means to indicate that the controlled condition of the actuator is the non-operable condition with the first operating member being operated.

* * * * *